US011377908B2

(12) United States Patent
Cabral

(10) Patent No.: US 11,377,908 B2
(45) Date of Patent: Jul. 5, 2022

(54) LADDER APRON

(71) Applicant: James Cabral, Nantucket, MA (US)

(72) Inventor: James Cabral, Nantucket, MA (US)

( * ) Notice: Subject to any disclaimer, the term of this patent is extended or adjusted under 35 U.S.C. 154(b) by 184 days.

(21) Appl. No.: 16/838,223

(22) Filed: Apr. 2, 2020

(65) Prior Publication Data

US 2021/0310306 A1 Oct. 7, 2021

(51) Int. Cl.
*E06C 7/14* (2006.01)
*E06C 1/12* (2006.01)

(52) U.S. Cl.
CPC . *E06C 7/14* (2013.01); *E06C 1/12* (2013.01)

(58) Field of Classification Search
CPC ..... E06C 7/14; E06C 1/12; E06C 7/143
See application file for complete search history.

(56) References Cited

U.S. PATENT DOCUMENTS 5,639,003 A * 6/1997 Utzinger, III ..... A45F 3/00 224/904
5,647,453 A 7/1997 Cassells
5,813,530 A 9/1998 Kornblatt
5,971,101 A * 10/1999 Taggart ..... E06C 7/14 182/129
5,988,383 A * 11/1999 Armstrong ..... E06C 7/14 182/129
6,098,748 A * 8/2000 Harper, Jr. ..... E06C 7/14 206/372
6,435,304 B1 8/2002 Stierle
6,565,051 B2 * 5/2003 Vaglica ..... E06C 7/14 248/210
9,038,869 B2 5/2015 Moreau et al.
9,943,956 B1 * 4/2018 Giamanco ..... B25H 3/04
2002/0070136 A1 6/2002 Hedges
2014/0083888 A1 * 3/2014 Constable ..... E06C 7/14 206/349
2019/0047137 A1 * 2/2019 Allen ..... B25H 3/00

* cited by examiner

*Primary Examiner* — Kimberly T Wood
(74) *Attorney, Agent, or Firm* — Lando & Anastasi, LLP

(57) ABSTRACT

An apron including two sleeves for fitting around the rails of a straight ladder or an extension ladder to aid a worker, such as a roofer. The apron includes one or more pockets and loops for storing building materials and tools. A soft and flexible material is used to construct the apron so that it may be folded for convenient storage when not in use.

19 Claims, 7 Drawing Sheets

LADDER APRON

FIELD

At least one example in accordance with the present invention relates generally to an accessory for ladders, and specifically to an apron for straight ladders or extension ladders.

BACKGROUND

In the construction industry, ladders are used to access elevated areas of structures, including roofs. When accessing a roof, a straight ladder is often used. A straight ladder includes two parallel rails connected by steps or rungs. A particular type of straight ladder is an extension ladder, which does not support itself, unlike an A frame ladder, such as a step ladder. During a roofing construction project, an extension ladder is leaned against an edge of a roof so that a worker can access the roof as well as carry tools and equipment to the roof.

A worker often wears a tool belt around his waist while traversing up and down the ladder to access the roof. Keeping tools and equipment on hand has a benefit of convenient access for the worker, but includes a drawback of being encumbered by additional weight and making it difficult for the worker to operate in certain positions. When ascending and descending a ladder while wearing a tool belt, particularly when loaded with tools and building materials, such as hammers, nails, and screws, the tool belt or attached tools can become snagged on the ladder, leading to possible injury of the worker.

In other situations, a worker may leave his tool belt on the roof in order to unencumber himself. Removing the tool belt is beneficial to the worker because it gives him more flexibility to handle building materials and only use the equipment he needs at the moment, such as a hammer and a handful of nails. However, the separated tool belt poses a risk of falling off the roof and injuring a person below.

What is needed is an accessory that combines the benefit of convenient access to tools and building materials with the benefit of unencumbering the worker without the drawbacks associated with previous approaches.

SUMMARY

Aspects and embodiments are directed to an apron for use with a ladder including a straight ladder and an extension ladder. In one embodiment, the apron comprises a first sleeve configured to fit over an end of a first rail of the ladder, a second sleeve configured to fit over an end of a second rail of the ladder, and a panel of material secured to the first sleeve and to the second sleeve, the panel including at least one pocket attached to a front side of the panel.

In one embodiment, each of the first sleeve and the second sleeve is enclosed on a top end thereof and is open on a bottom end thereof, the arrangement being such that the first sleeve and the second sleeve slide over the end of the first rail and the end of the second rail, respectively. The first sleeve is configured to slide over an end cap of the first rail and the second sleeve is configured to slide over an end cap of the second rail.

In another embodiment, the at least one pocket includes a flap configured to close an open edge of the at least one pocket.

In one embodiment, the apron further comprises at least one button or at least one magnet attached to the at least one pocket, the flap, or the front side of the panel.

In another embodiment, the apron further comprises at least one first portion of a hook-and-loop fastener material attached to the at least one pocket or the front side of the panel, and at least one second portion of a hook-and-loop fastener material attached to the flap.

In one embodiment, the apron further comprises a first portion of at least one metal snap fastener attached to the at least one pocket or the front side of the panel, and a second portion of the at least one metal snap fastener attached to the flap.

In another embodiment, the apron further comprises at least one button, metal snap fastener, magnet, or hook-and-loop faster configured to open and close the at least one pocket.

In one embodiment, the apron further comprises at least two pockets attached to the front side of the panel.

In another embodiment, at least one of the first sleeve and the second sleeve includes a loop configured to hold a tool.

In one embodiment, each of the first sleeve and the second sleeve includes a loop configured to hold a tool.

In another embodiment, the apron further comprises at least one safety strap secured to the panel, the at least one safety strap being configured to secure the apron to the ladder.

In one embodiment, the safety strap includes a first portion secured to one side of the panel and a second portion secured to an opposite side of the panel, a detachable buckle having a first buckle portion attached to the first portion of the strap and a second buckle portion attached to the second portion of the strap.

In another embodiment, the safety strap is affixed horizontally to the apron, such that the strap runs approximately parallel to rungs of the ladder and wraps around both the first rail and the second rail of the ladder.

In one embodiment, the safety strap includes a first portion secured to one side of the panel and a second portion secured to an opposite side of the panel, a first portion of a hook-and-loop fastener material attached to the first portion of the safety strap and a second portion of a hook-and-loop fastener material attached to the second portion of the safety strap.

In another embodiment, the apron is made of a material including one or more of: canvas, cotton, burlap, polyester, denim, polyvinyl chloride (PVC), leather, and nylon.

In one embodiment, the panel is stitched along one edge thereof to the first sleeve and along an opposite edge thereof to the second sleeve.

BRIEF DESCRIPTION OF DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. In the figures, each identical or nearly identical component that is illustrated in various figures is represented by a like numeral. For purposes of clarity, not every component is labeled in every figure. In the figures.

DETAILED DESCRIPTION

Examples of the ladder aprons discussed herein are not limited in application to the details of construction and the arrangement of components set forth in the following description or illustrated in the accompanying drawings. The ladder aprons of embodiments of the present disclosure are capable of implementation in other embodiments and of being practiced or of being carried out in various ways. Examples of specific implementations are provided herein for illustrative purposes only and are not intended to be limiting. In particular, components, elements and features discussed in connection with any one or more examples are not intended to be excluded from a similar role in any other examples.

Also, the phraseology and terminology used herein is for the purpose of description and should not be regarded as limiting. Any references to examples, embodiments, components, or elements of the ladder aprons herein referred to in the singular may also embrace embodiments including a plurality, and any references in plural to any embodiment, component, or element herein may also embrace embodiments including only a singularity. References in the singular or plural form are not intended to limit the presently disclosed systems or methods, their components, or elements. The use herein of "including," "comprising," "having," "containing," "involving," and variations thereof is meant to encompass the items listed thereafter and equivalents thereof as well as additional items.

References to "or" may be construed as inclusive so that any terms described using "or" may indicate any of a single, more than one, and all of the described terms. In addition, in the event of inconsistent usages of terms between this document and documents incorporated herein by reference, the term usage in the incorporated features is supplementary to that of this document; for irreconcilable differences, the term usage in this document controls.

Examples described herein provide ladder aprons for use with straight ladders and extension ladders. In various examples, an apron is provided which has two sleeves configured to slide over two rails of a straight ladder or an extension ladder. The apron is useable with other types of ladders having two protruding rail portions similar to straight or extension ladders. The apron is made of a soft and flexible material that allows the apron to be conveniently folded and stored when not in use.

Figure 1:
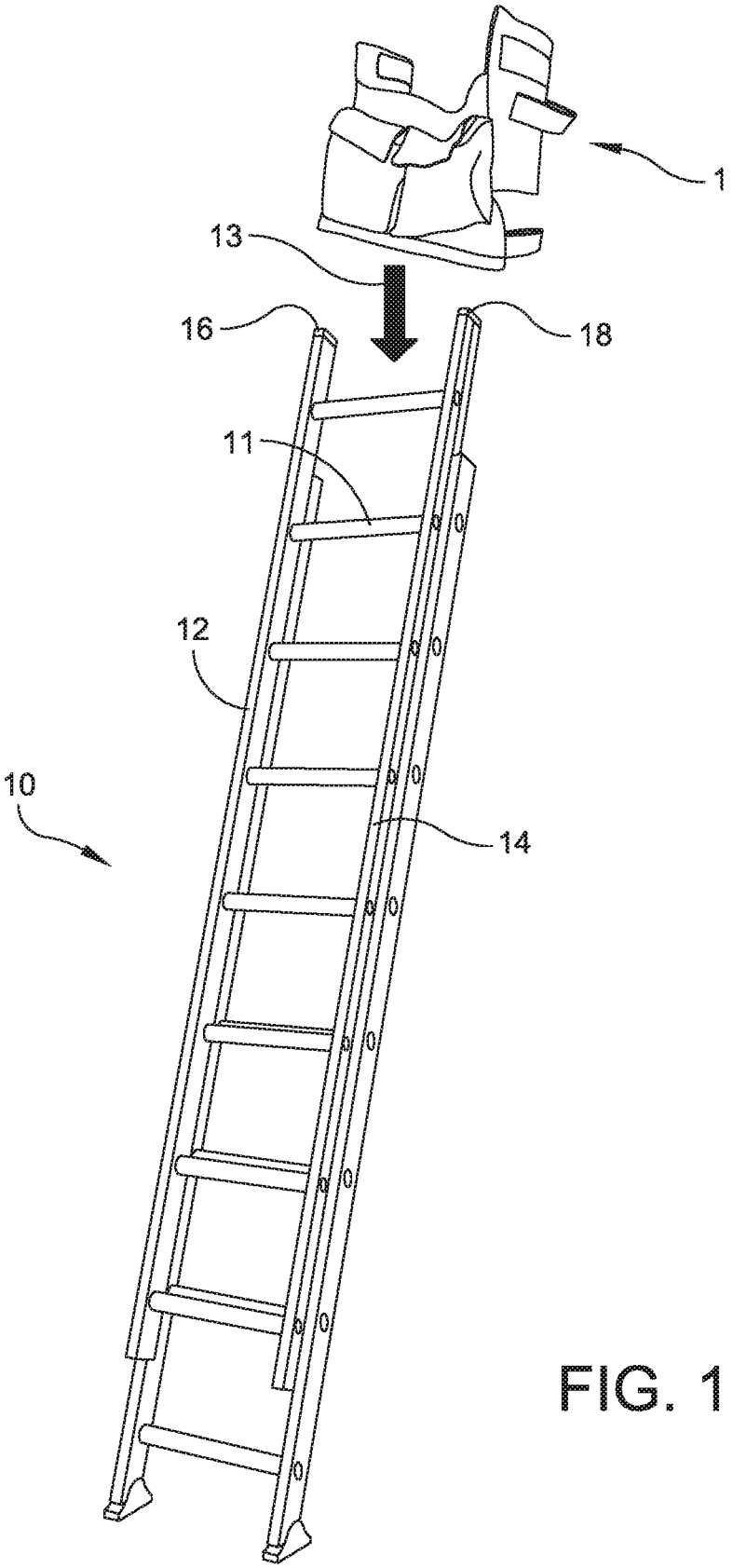
FIG. 1 illustrates a view of a ladder apron of an embodiment of the present disclosure being placed over rails of an extension ladder.

Referring now to the drawings, and more particularly to FIG. 1, an extension ladder 10 includes a first rail 12, a second rail 14, and one more steps or rungs 11 that separate the first rail 12 from the second rail 14 by a fixed distance. The first rail 12 has an end cap 16 and the second rail 14 has an end cap 18. In one embodiment, the extension ladder 10 includes two sections that operate with one another to extend or shorten the overall length of the ladder. As shown, a ladder apron 1 is placed over the first rail 12 and the second rail 14 of extension ladder 10 in a direction 13 towards the ladder.

While FIG. 1 shows an extension ladder being used with ladder apron 1, any suitable straight ladder or ladder having rails may be used with ladder apron 1. As explained in more detail below, the ladder apron 1 is secured to the rails of the ladder via specially designed sleeves, with the sleeves sliding over the rails 12, 14 of the ladder 10.

The material or materials used to construct the ladder apron 1 can be selected depending on the desired cost and structural integrity desired for the ladder apron. For example, the ladder apron 1 can be constructed from one or one or more of: canvas, cotton, burlap, polyester, denim, polyvinyl chloride (PVC), leather, and nylon. While a rigid design is contemplated where the apron 1 is constructed from a material such as a hard plastic or a metal, using a soft and flexible material to construct the apron is preferred as it allows the apron to be conveniently folded and stored in small places or laid flat to occupy minimal storage space.

In an example, the ladder apron 1 is constructed using one or more pieces of material either sewn together, bonded together with an adhesive, riveted together, or through a combination of these attachment processes. The ladder apron 1 may be constructed with the same material throughout or with different materials depending on aesthetic and/or design needs.

Figure 2A:
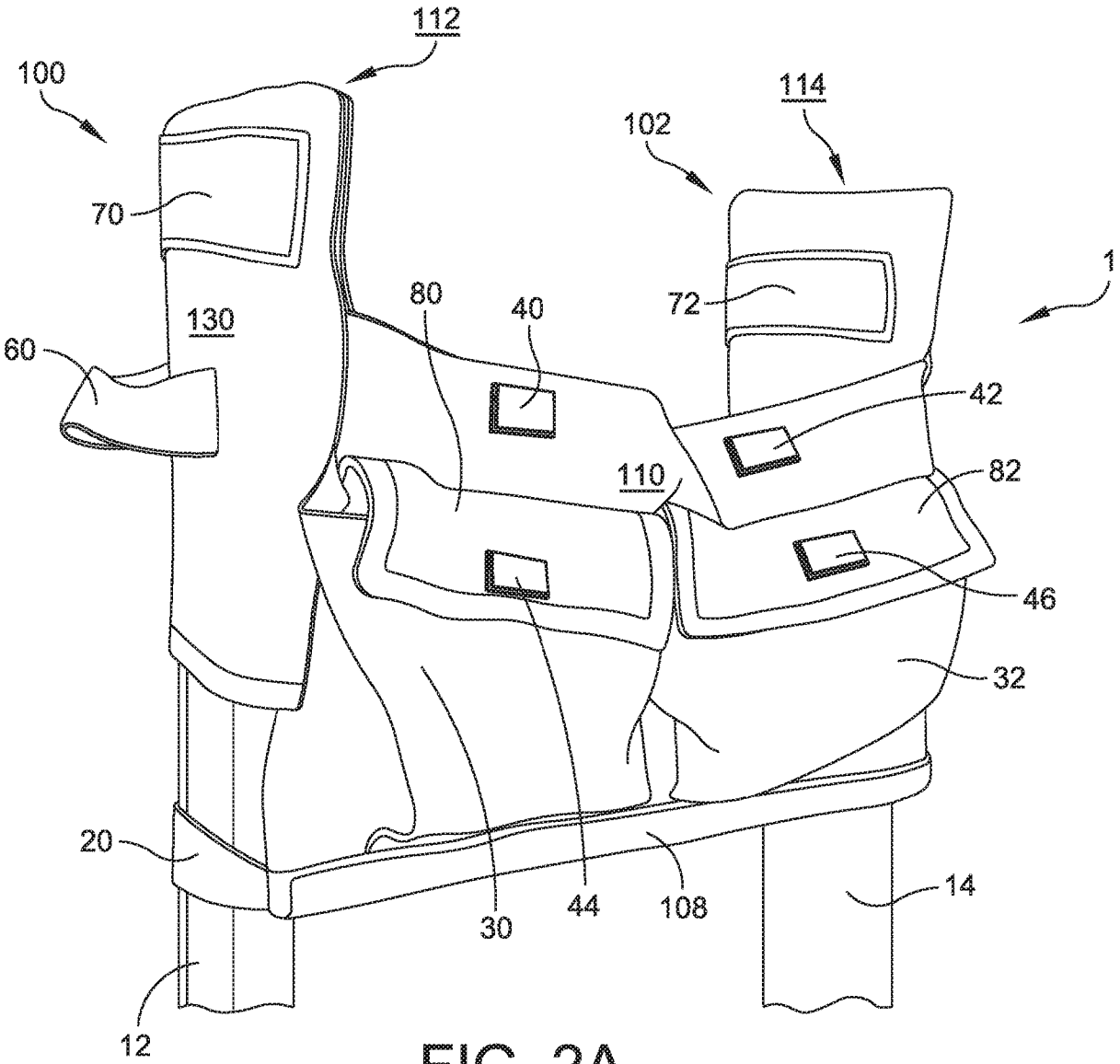
FIG. 2A illustrates a front view from one perspective of the ladder apron secured to the extension ladder.

Referring to FIG. 2A, the ladder apron 1 is secured to the first rail 12 and the second rail 14 of the extension ladder 10. As shown, the ladder apron 1 includes a panel 108, a first sleeve 100 secured (as by stitching) to one side of the panel, and a second sleeve 102 secured (as by stitching) to an opposite side of the panel. The ladder apron 1 is configured so that the first sleeve 100 slips over the end of the first rail 12 and the second sleeve 102 slips over the end of the second rail 14 to secure the ladder apron to the extension ladder, with the panel 108 extending between the first rail 12 and the second rail 14. The ladder apron 1 further includes a safety strap having a first strap portion 20 and a second strap portion 22 (shown in FIG. 2B). The ladder apron 1 further includes hook-and-loop fastener 70 and hook-and-loop fastener 72 provided on respective sleeves 100, 102. The safety strap including first and second strap portions 20, 22 is discussed in more detail in the discussion of FIG. 3A and FIG. 3B.

In an example, as shown in FIG. 2A, the first sleeve 100 has a loop 60 that is configured to hold a tool, such as a hammer. In another example, the loop 60 is configured to hold a screwdriver. In one example, the loop 60 is constructed from a material that stretches, such as elastic, so that a worker secures a tool to the first sleeve 100 by stretching the loop 60 around a tool and then releasing the loop 60 to secure the tool in place. In another example, the loop 60 is constructed from the same material as apron 1.

When first sleeve 100 completely slides over first rail 12, the loop 60 is arranged such that side 130 of the first sleeve is approximately perpendicular to front side 110 of the panel 108, thereby keeping a tool held by loop 60 away from interfering with other components of the ladder apron 1.

Figure 2B:
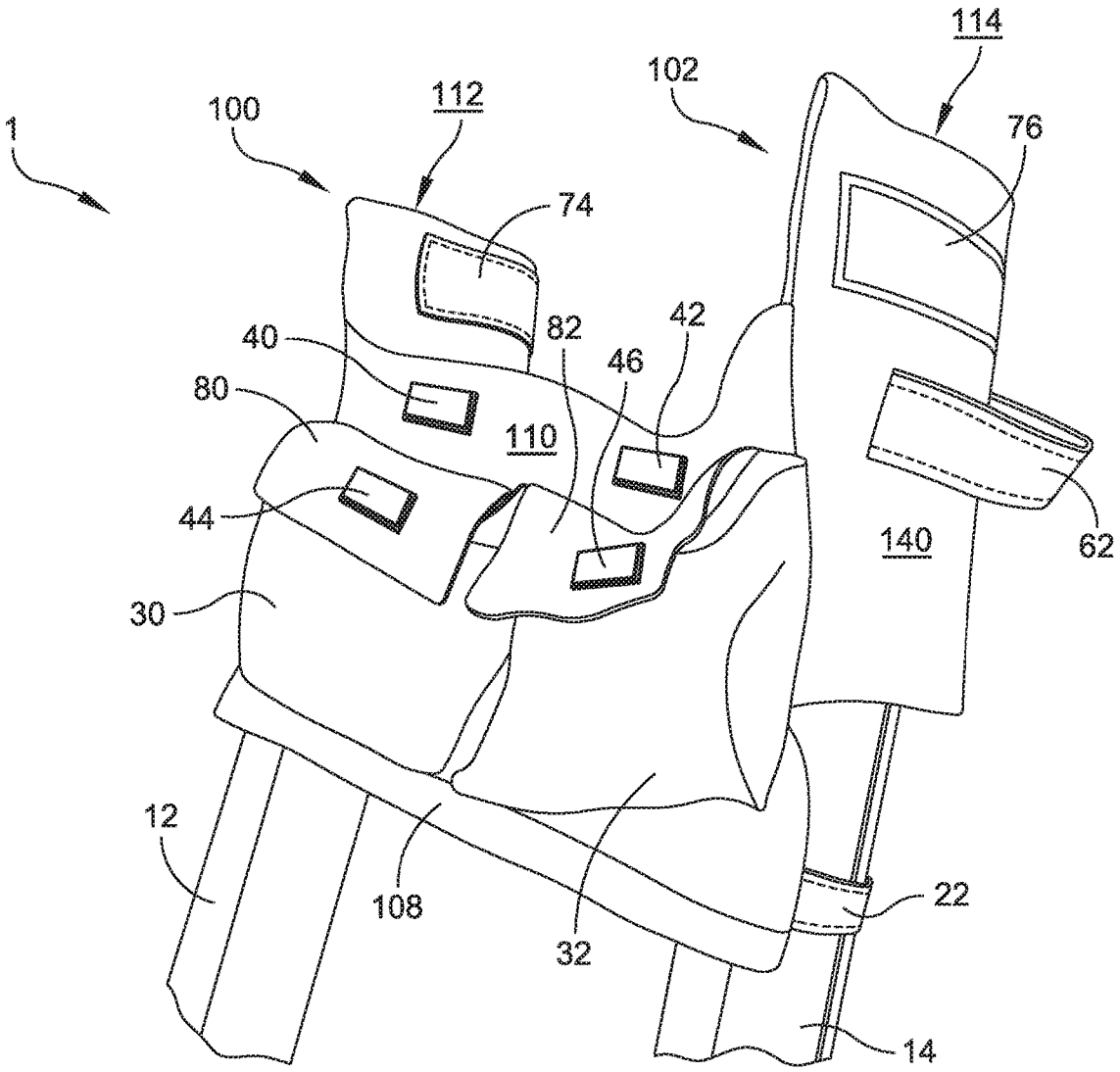
FIG. 2B illustrates a front view from another perspective of the ladder apron secured to the extension ladder.

FIG. 2B is a front view of the ladder apron 1 from a different perspective than FIG. 2A, showing the ladder apron 1 being secured to the first rail 12 and the second rail 14 using the first sleeve 100, the second sleeve 102, and the safety strap having the second strap portion 22. The ladder apron 1 includes hook-and-loop fastener 74 and hook-and-loop fastener 76 secured to the first sleeve 100 and the second sleeve 102, respectively.

In one example, as shown in FIG. 2B, the second sleeve 102 has a loop 62 that is configured to hold a tool, such as a hammer. In another example, the loop 62 is configured to hold a tool, such as a screwdriver. In one example, the loop 62 is constructed from a material that stretches, such as elastic, so that a worker secures a tool to the second sleeve 102 by stretching the loop 62 around a tool and then releasing the loop 62 to secure the tool in place. In another example, the loop 62 is constructed from the same material as apron 1.

When second sleeve 102 completely slides over second rail 14, the loop 62 is arranged such that side 140 of the second sleeve is approximately perpendicular to the front side 110 of the panel 108, thereby keeping a tool held by loop 62 away from interfering with other components of the ladder apron 1.

The first sleeve 100 is constructed to easily slip over the first rail 12 when the ladder apron is secured to the extension ladder 10. Similarly, the second sleeve 102 is constructed to easily slip over the second rail 14 when the ladder apron is secured to the extension ladder 10. One method of securing the ladder apron 1 to the extension ladder 10 is to simultaneously slip the first sleeve 100 over the first rail 12 and the second sleeve 102 over the second rail 14 until the ends of the rails 12, 14 engage the ends of the first and second sleeves.

As shown in FIG. 2A and FIG. 2B, the first sleeve 100 is connected to the second sleeve 102 via the panel 108. The panel 108 includes one or more pockets. As shown in FIG. 2A, the ladder apron 1 includes a first pocket 30 and a second pocket 32 secured to the front 110 of the panel 108. While the dimensions (i.e., length and width) of the panel 108 depend on the width between the first rail 100 and the second rail 102, typically 15-20 inches, the ladder apron 1 may be constructed to fit over any ladder width.

The ladder apron 1 has a top edge 112 of first sleeve 100 and a top edge 114 of second sleeve 102. The top edge 112 is approximately co-planar with top edge 114 since the end caps 16, 18 of the rails 12, 14, respectively, terminate at a common distance. When the first sleeve 100 completely slides over rail 12, the interior of the sleeve beneath the top edge 112 comes into contact with end cap 16 (or the top of rail 12 if no end cap 16 is present). Likewise, when the second sleeve 102 completely slides over rail 14, the interior of the sleeve beneath the top edge 114 comes into contact with end cap 18 (or the top of rail 14 if no end cap 18 is present). If the ladder 10 does not have one or two end caps, the apron would still function as expected.

In one example, each pocket 30, 32 is the same size such that their combined width spans the nearly or all of the entirety of the width of the panel 108 in order to maximize the number of tools, equipment, or fasteners that can be placed inside the pockets. In another example, one pocket is larger (in length, width, and/or depth) than the other pocket. In an example, pocket 30 is larger than pocket 32. In another example, pocket 32 is larger than pocket 30. In one example, the pockets are arranged in different configurations. In an example, pocket 30 is arranged above pocket 32 on panel 108. In another example, pocket 32 is arranged above pocket 30 on panel 108. In one example, one or more pockets may be included on panel 108 in addition to pocket 30 and pocket 32.

In an example, each pocket 30, 32 attached to the front side 110 of apron 1 along panel 108 has a respective flap to secure the contents of the respective pocket. For example, flap 80 encloses pocket 30 and flap 82 encloses pocket 32.

In one example, to keep the flap 80 in an open position (shown in FIG. 3A), a pair of pair of hook-and-loop fasteners 40, 44 are connected to one another to secure the flap in the open position. In another example, more than two hook-and-loop fasteners are attached to the flap 80 and a corresponding area of the panel 108 in order to keep the flap 80 open.

In one example, to keep the flap 82 in an open position (shown in FIG. 3A), a pair of pair of hook-and-loop fasteners 42, 46 are connected to one another to secure the flap in the open position. In another example, more than two hook-and-loop fasteners are attached to the flap 82 and a corresponding area of the panel 108 in order to keep the flap 82 open.

In another example of ladder apron 1, each flap 80, 82 is secured in the open position using one or more metal snap fasteners in place of or in addition to using hook-and-loop fasteners 40, 44, and 42, 46, respectively.

In one example of ladder apron 1, each flap 80, 82 is secured in the open position using one or more magnets in place of or in addition to using hook-and-loop fasteners 40, 44, and 42, 46, respectively.

In another example of ladder apron 1, each flap 80, 82 is secured in the open position using one or more buttons in place of or in addition to using hook-and-loop fasteners 40, 44, and 42, 46, respectively. The one or more buttons are used to keep each flap 80 and 82 secured in the open position, where the one or more buttons are placed in the same locations as hook-and-loop fasteners 40, 42, and one or more respective slot portions in the flaps 80, 82, respectively, are configured to receive the one or more buttons in the same locations as hook-and-loop fasteners 44, 46.

Figure 3A:
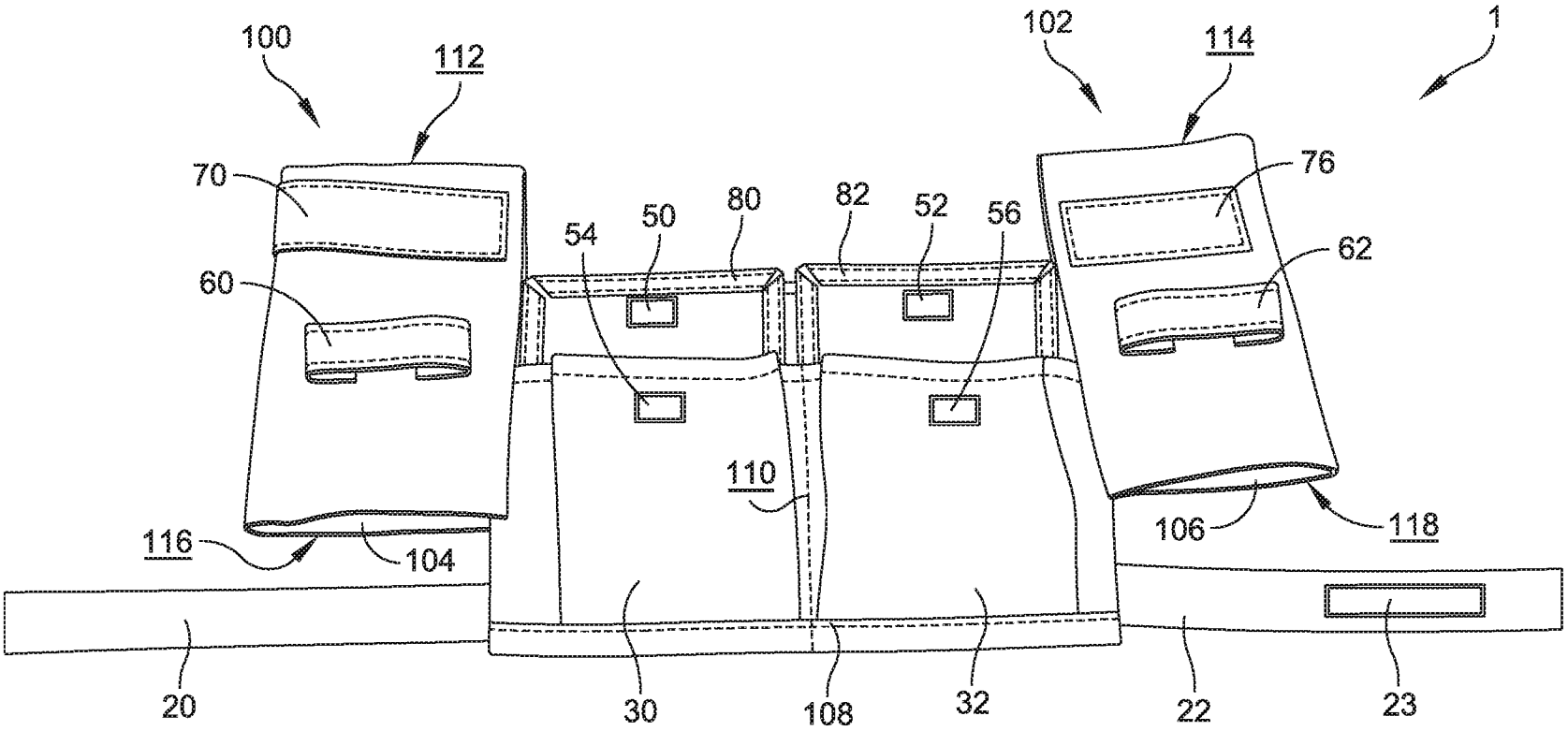
FIG. 3A illustrates a front view of the ladder apron laid flat.
Figure 3B:
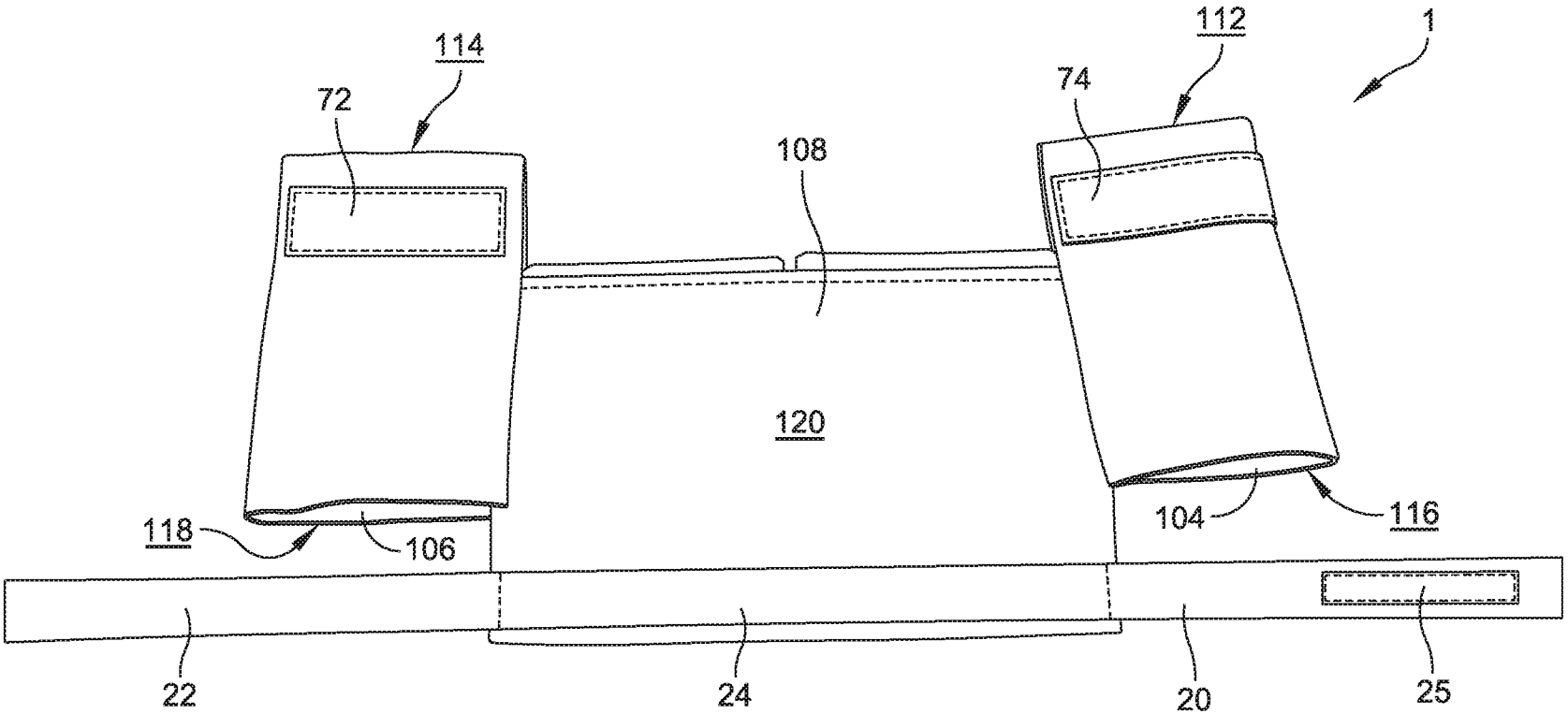
FIG. 3B illustrates a back view of the ladder apron laid flat.

FIG. 3A is a front view of a ladder apron 1 laid flat with front side 110 of the ladder apron 1 being shown. FIG. 3B is a back view of the ladder apron 1, opposite to a side 120. As discussed above, the ladder apron 1 includes the safety strap having the first strap portion 20 and the second strap portion 22. The safety strap is affixed horizontally to the apron, such that the strap runs approximately parallel to rungs or steps 11 of ladder 10 and wraps around both the first rail 12 and the second rail 14. The second strap portion 22 includes a hook-and-loop fastener 23. The first sleeve 100 includes an opening 104 configured to receive the first rail 12 at a bottom side 116 of the first sleeve of the ladder apron 1. Similarly, the second sleeve 102 includes an opening 106 configured to receive second rail 14 at a bottom side 118 of the second sleeve of the ladder apron 1. The bottom side 116 is co-planar with bottom side 118.

In one example, ladder apron 1 is folded by attaching hook-and-loop fastener 76 to hook-and-loop fastener 70.

In one example, to keep flap 80 in a closed position (shown in FIG. 1, FIG. 2A and FIG. 2B), a pair of pair of hook-and-loop fasteners 50 and 54 are connected. As shown, the hook and loop fastener 50 is secured to an inner surface of the flap 80 and the hook and loop fastener 54 is secured to an outer surface of the pocket 30. In another example, more than two hook-and-loop fasteners can be attached to flap 80 and a corresponding area of pocket 30 in order to keep flap 80 closed.

In one example, to keep flap 82 in a closed position (shown in FIG. 1, FIG. 2A and FIG. 2B), a pair of pair of hook-and-loop fasteners 52, 56 are connected. As shown, the hook and loop fastener 52 is secured to an inner surface of the flap 82 and the hook and loop fastener 56 is secured to an outer surface of the pocket 32. In another example, more than two hook-and-loop fasteners can be attached to flap 82 and a corresponding area of pocket 32 in order to keep flap 82 closed.

In another example of ladder apron 1, each flap 80, 82 is secured in the closed position using one or more metal snap fasteners in place of or in addition to using hook-and-loop fasteners 50, 54, and 52, 56, respectively.

In another example of ladder apron 1, each flap 80, 82 is secured in the closed position using one or more magnets in place of or in addition to using hook-and-loop fasteners 50, 54, and 52, 56, respectively.

In another example of ladder apron 1, each flap 80, 82 is secured in the closed position using one or more buttons in place of or in addition to using hook-and-loop fasteners 50, 54, and 52, 56, respectively. The one or more buttons are used to keep each flap 80, 82 secured in the closed position, where the one or more buttons are placed in the same locations as hook-and-loop fasteners 54, 56, and one or more respective slot portions in each flap 80, 82 are configured to receive the one or more buttons in the same locations as hook-and-loop fasteners 50, 52.

In another example of ladder apron 1, metal snap fasteners are used in place of one or both of the pair of hook-and-loop fasteners 70, 76 and the pair of hook-and-loop fasteners 72, 74.

In another example of ladder apron 1, magnets are used in place of one or both of the pair of hook-and-loop fasteners 70, 76 and the pair of hook-and-loop fasteners 72, 74.

In one example of ladder apron 1, loop 60 and loop 62 are the same size (i.e. length, width, and/or thickness). In another example, one of loop 60 or loop 62 is a different size in order to accommodate a different size tool.

Referring to FIG. 3B, the ladder apron 1 is laid flat with side 120 of the ladder apron 1 being shown. The ladder apron 1 includes a safety strap having a middle portion 24 attached to panel 108. The middle portion 24 is attached to the panel 108 and extends across the entire width of the panel 108 on side 120 of ladder apron 1. In one embodiment, he safety strap including the first strap portion 20, the second strap portion 22 and the middle portion 24 embody a contiguous strap.

In one example, ladder apron 1 is folded by attaching hook-and-loop fastener 74 to hook-and-loop fastener 72.

In an example, to prevent ladder apron 1 from moving away from ladder 10, the safety strap is wrapped around ladder 10 (shown in FIG. 2A and FIG. 2B) and secured by attaching the hook-and-loop fastener 23 to hook-and-loop fastener 25, such that the first strap portion 20 of the safety strap wraps around first rail 12 and the second strap portion 22 of the safety strap wraps around second rail 14.

In another example of ladder apron 1, the first strap portion 20 of the safety strap is attached to the second strap portion 22 of the safety strap using one or more metal snap fasteners in place of or in addition to using hook-and-loop fasteners 23, 25.

In another example of ladder apron 1, the first strap portion 20 of the safety strap is attached to the second strap portion 22 of the safety strap using one or more magnets in place of or in addition to using hook-and-loop fasteners 23, 25.

In another example of ladder apron 1, the first strap portion 20 of the safety strap is attached to the second strap portion 22 of the safety strap using one or more buttons in place of or in addition to using hook-and-loop fasteners 23, 25. When a button is used in place of hook-and-loop fastener 23, a slot portion in the first strap portion 20 of the safety strap is configured to receive the button. When a button is used in place of hook-and-loop fastener 25, a slot portion in the second strap portion 22 of the safety strap is configured to receive the button.

In another example of ladder apron 1, the pair of hook-and-loop fasteners 72 and 74 are attached using metal snap fasteners in place of or in addition to using hook-and-loop fasteners 72, 74.

In another example of ladder apron 1, the pair of hook-and-loop fasteners 72 and 74 are attached using magnets in place of or in addition to using hook-and-loop fasteners 72, 74.

In one example of ladder apron 1, hook-and-loop fasteners 70, 74, 72, 76 are not included in ladder apron 1.

In another example of ladder apron 1, one or both of flaps 80 and 82 are not included in ladder apron 1, along with their respective fasteners 40, 42, 44, 46, 50, 52, 54, or 56.

Figure 4A:
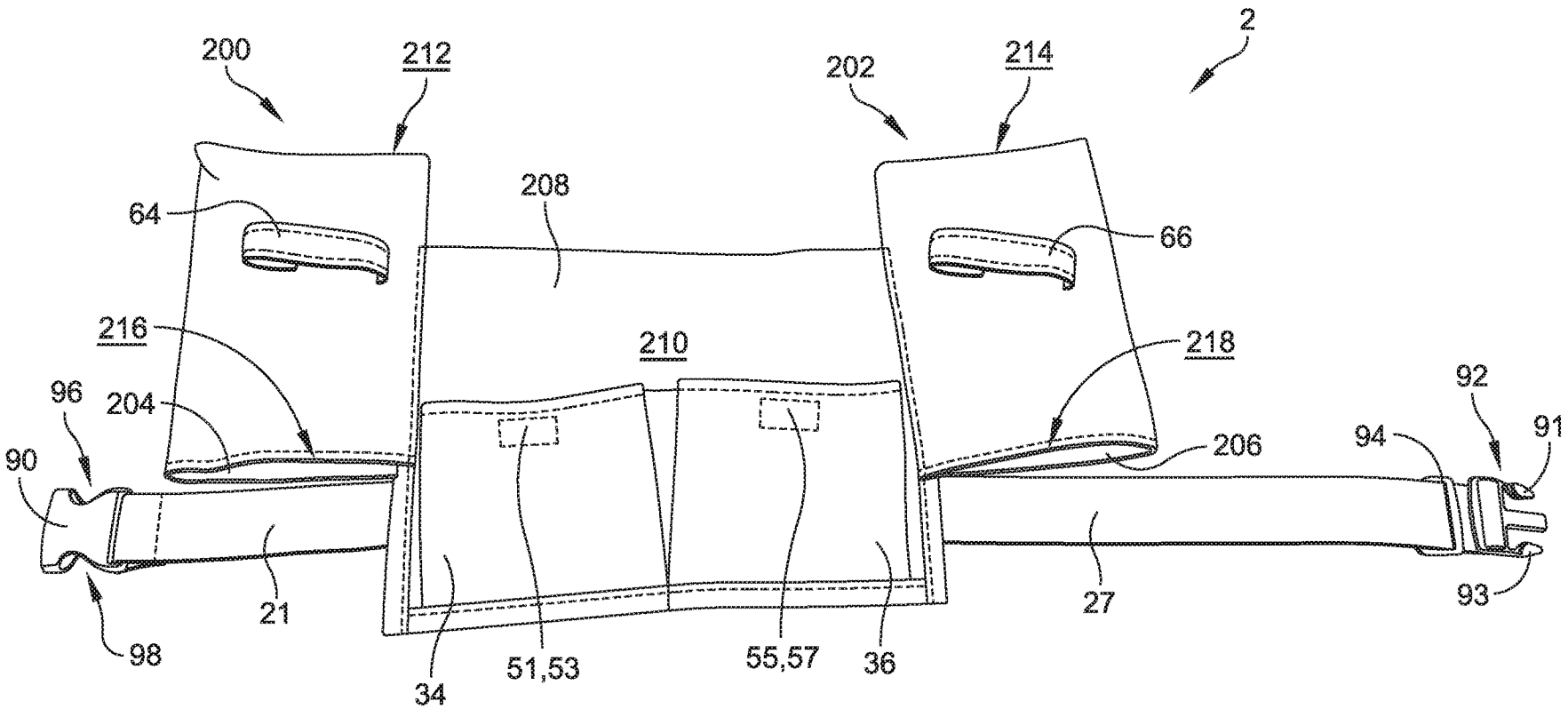
FIG. 4A illustrates a front view of a ladder apron of another embodiment of the present disclosure laid flat.

FIG. 4A is a front view of a ladder apron 2 of another embodiment, which is laid flat. The ladder apron 2 includes a panel 208, a first sleeve 200 secured (as by stitching) to one side of the panel, and a second sleeve 202 secured (as by stitching) to an opposite side of the panel. The ladder apron 2 is configured so that the first sleeve 200 slips over the end of the first rail 12 and the second sleeve 202 slips over the end of the second rail 14 to secure the ladder apron to the extension ladder 10. The ladder apron 2 further includes a pocket 34 provided on the panel 208, another pocket 36 provided on the panel 208, a loop 64 provided on the first sleeve 200, a loop 66 provided on the second sleeve 202, an opening 204, and opening 206, a top edge 212 associated with the first sleeve 200, a top edge 214 associated with second sleeve 202, a bottom side 216 associated with the first sleeve 200, and a bottom side 218 associated with the second sleeve 202. For purposes of brevity, ladder apron 2 will be described in further detail where it differs from ladder apron 1. All discussion of ladder apron 1 is intended to apply to ladder apron 2 for corresponding components unless otherwise noted herein.

In one example of ladder apron 2, the pocket 34 is created by stitching material to the panel 208 to create a pocket having an open top that is closed by a pair of hook-and-loop fasteners 51, 53 locate inside pocket 34, with hook-and-loop fastener 51 being attached to the interior surface of pocket 34 and hook-and-loop fastener 53 being attached to the outer surface of the panel 208 of side 210 of ladder apron 2.

In another example of ladder apron 2, pocket 34 does not include any fasteners.

In one example of ladder apron 2, the pocket 36 is created by stitching material to the panel 208 to create a pocket having an open top that is closed by a pair of hook-and-loop fasteners 55, 57 locate inside pocket 36, with hook-and-loop fastener 55 being attached to the interior surface of pocket 36 and hook-and-loop fastener 57 being attached to the outer surface of the panel 208 of side 210 of apron 2.

In another example of ladder apron 2, pocket 36 does not include any fasteners.

The hook-and-loop fasteners 51, 55, 53, 57 of ladder apron 2 may be substituted or supplemented metal snap fasteners, magnets, or buttons.

In another example of ladder apron 2, one or both of pocket 34 and pocket 36 has a flap and corresponding fasteners similar to ladder apron 1 discussed above.

In an example of ladder apron 2, pocket 34 and pocket 36 do not have any flaps attached.

In another example of ladder apron 2, first sleeve 200 and second sleeve 200 do not have any fasteners attached.

One example of ladder apron 2 includes a safety strap having a first strap portion 21 and a second strap portion 27.

A female buckle portion 90 is attached to the first strap portion 21. A male buckle portion 92 is attached to the second strap portion 27. The female buckle portion 90 is configured to receive male buckle portion 92. The male buckle portion 92 includes flexible prongs 91, 93 that bend when inserted into female buckle portion 90 and lock into corresponding open areas 96, 98 of female buckle portion 90. The length of the safety strap is adjustable using adjusting portion 94 attached to second strap portion 27. To release the safety strap, the flexible prongs 91, 93 of male buckle portion 92 are pressed toward one another within the open areas 96, 98 of female buckle portion 90.

Figure 4B:
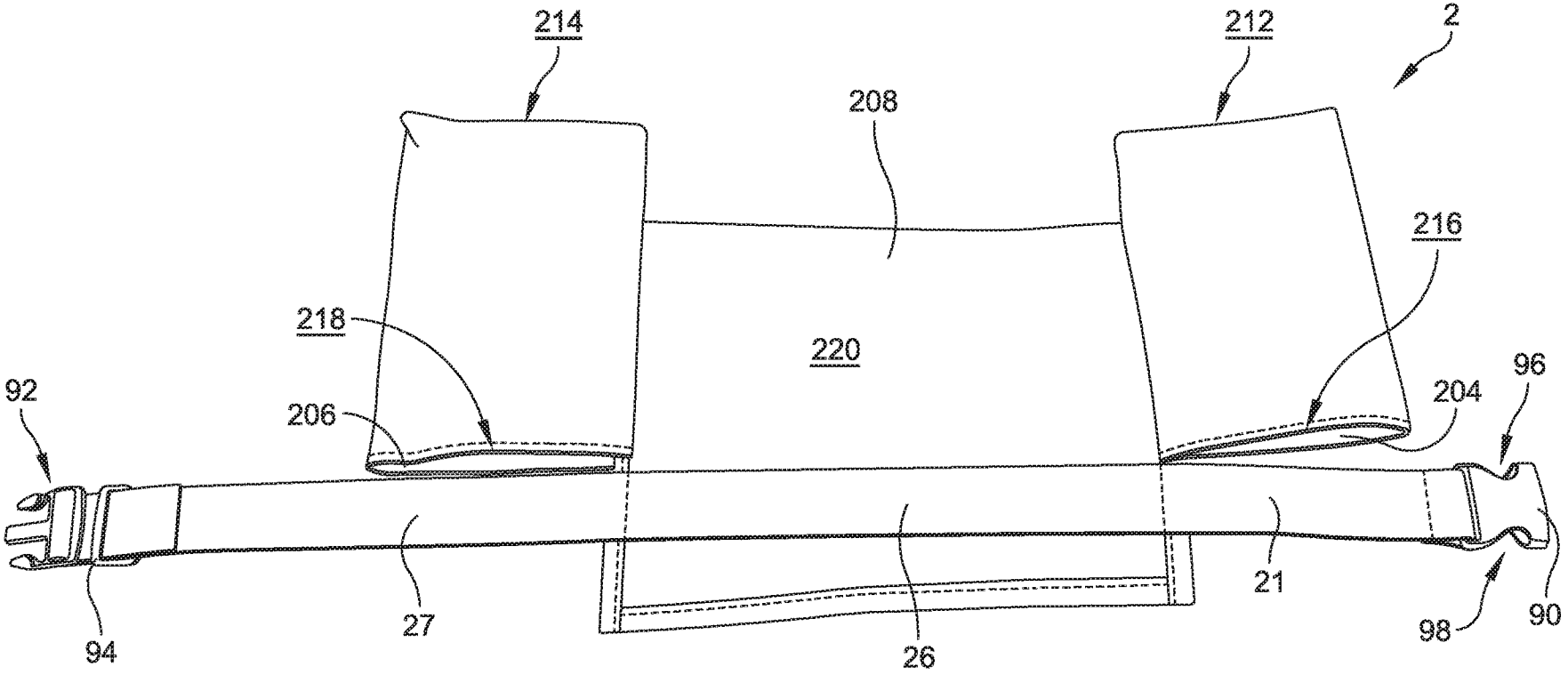
FIG. 4B illustrates a back view of the ladder apron laid flat.

Referring to FIG. 4B, the ladder apron 2 is laid flat with side 220 of the ladder apron 2 being shown. The safety strap includes a middle portion 26 attached to panel 208. The middle portion 26 extends across the entire width of the panel 208 on side 220 of ladder apron 2.

Having thus described several aspects of at least one embodiment, it is to be appreciated various alterations, modifications, and improvements will readily occur to those skilled in the art. Such alterations, modifications, and improvements are intended to be part of, and within the spirit and scope of, this disclosure. Accordingly, the foregoing description and drawings are by way of example only.

What is claimed is:

1. An apron for use with a ladder including a straight ladder and an extension ladder, the apron comprising:

a first sleeve configured to fit over an end of a first rail of the ladder;

a first fastener attached to the first sleeve;

a second sleeve configured to fit over an end of a second rail of the ladder;

a second fastener attached to the second sleeve and configured to be attached to the first fastener; and a panel of material secured to the first sleeve and to the second sleeve, the panel including at least one pocket attached to a front side of the panel, the panel being configured to be folded from a use position to a stored position and maintained in the stored position by the first fastener being attached to the second fastener.

2. The apron of claim 1, wherein each of the first sleeve and the second sleeve is enclosed on a top end thereof and is open on a bottom end thereof, the arrangement being such that the first sleeve and the second sleeve slide over the end of the first rail and the end of the second rail, respectively.

3. The apron of claim 2, wherein the first sleeve is configured to slide over an end cap of the first rail and the second sleeve is configured to slide over an end cap of the second rail.

4. The apron of claim 1, wherein the at least one pocket includes a flap configured to close an open edge of the at least one pocket.

5. The apron of claim 4, further comprising at least one button or at least one magnet attached to the at least one pocket, the flap, or the front side of the panel.

6. The apron of claim 4, further comprising at least one first portion of a hook-and-loop fastener material attached to the at least one pocket or the front side of the panel, and at least one second portion of a hook-and-loop fastener material attached to the flap.

7. The apron of claim 4, further comprising a first portion of at least one metal snap fastener attached to the at least one pocket or the front side of the panel, and a second portion of the at least one metal snap fastener attached to the flap.

8. The apron of claim 1, further comprising at least one button, metal snap fastener, magnet, or hook-and-loop faster configured to open and close the at least one pocket.

9. The apron of claim 1, further comprising at least two pockets attached to the front side of the panel.

10. The apron of claim 1, wherein at least one of the first sleeve and the second sleeve includes a loop configured to hold a tool.

11. The apron of claim 1, wherein each of the first sleeve and the second sleeve includes a loop configured to hold a tool.

12. The apron of claim 1, further comprising at least one safety strap secured to the panel, the at least one safety strap being configured to secure the apron to the ladder.

13. The apron of claim 12, wherein the safety strap includes a first portion secured to one side of the panel and a second portion secured to an opposite side of the panel, a detachable buckle having a first buckle portion attached to the first portion of the strap and a second buckle portion attached to the second portion of the strap.

14. The apron of claim 12, wherein the safety strap is affixed horizontally to the apron, such that the strap runs approximately parallel to rungs of the ladder and wraps around both the first rail and the second rail of the ladder.

15. The apron of claim 12, wherein the safety strap includes a first portion secured to one side of the panel and a second portion secured to an opposite side of the panel, a first portion of a hook-and-loop fastener material attached to the first portion of the safety strap and a second portion of a hook-and-loop fastener material attached to the second portion of the safety strap.

16. The apron of claim 1, wherein the apron is made of a material including one or more of: canvas, cotton, burlap, polyester, denim, polyvinyl chloride (PVC), leather, and nylon.

17. The apron of claim 1, wherein the panel is stitched along one edge thereof to the first sleeve and along an opposite edge thereof to the second sleeve.

18. The apron of claim 1 further comprising:

a third fastener attached to the first sleeve; and a fourth fastener attached to the second sleeve and configured to be coupled to the third fastener.

19. An apron for use with a ladder including a straight ladder and an extension ladder, the apron comprising:

a first sleeve configured to fit over an end of a first rail of the ladder;

a second sleeve configured to fit over an end of a second rail of the ladder;

a panel of material secured to the first sleeve and to the second sleeve, the panel including at least one pocket attached to a front side of the panel; and a safety strap attached to a back side of the panel and configured to wrap around both the first rail and the second rail of the ladder.

* * * * *